United States Patent [19]

Myren

[11] Patent Number: 4,906,333

[45] Date of Patent: Mar. 6, 1990

[54] METHOD AND APPARATUS FOR EXTRACTING DUST THAT IS RELEASED WHEN CREPING OFF A PAPER WEB

[75] Inventor: Harry I. Myren, Karlstad, Sweden

[73] Assignee: Valmet Paper Machinery, Inc., Helsinki, Finland

[21] Appl. No.: 249,864

[22] Filed: Sep. 27, 1988

[30] Foreign Application Priority Data

Oct. 1, 1987 [SE] Sweden ..... 8703780

[51] Int. Cl.[4] ..... D21G 9/00

[52] U.S. Cl. ..... 162/111; 162/207; 162/272; 162/363; 15/256.51; 15/306 A

[58] Field of Search ..... 162/111, 202, 206, 272, 162/281, 363, 364, 207, 199, 283; 15/256.50, 256.51, 301, 306 A, 420, 421, 306 R, 308

[56] References Cited

U.S. PATENT DOCUMENTS

| | | | |
|---|---|---|---|
| 1,702,166 | 2/1929 | Lorenz | 162/281 |
| 2,082,411 | 6/1937 | Merrill | 15/306 A |
| 2,818,595 | 1/1958 | Rosenall | 15/306 A |
| 3,003,176 | 10/1961 | Goyette | 15/256.51 |
| 3,078,496 | 2/1963 | Doran et al. | 15/306 A |
| 3,121,904 | 2/1964 | Scott | 162/281 |
| 3,687,730 | 8/1972 | Murphy et al. | 162/272 |
| 3,775,806 | 12/1973 | Olbrant et al. | 15/306 A |
| 3,956,790 | 5/1976 | Ishinata et al. | 15/306 A |
| 4,019,953 | 4/1977 | Nystrom | 162/272 |
| 4,321,107 | 3/1982 | Page | 162/198 |

*Primary Examiner*—Richard V. Fisher
*Assistant Examiner*—Christopher Upton
*Attorney, Agent, or Firm*—Bell, Seltzer, Park & Gibson

[57] ABSTRACT

In a tissue paper machine, the dust that is released when the web is creped off the Yankee dryer (3) constitutes a major work environment problem. To provide an improved extraction of the dust and thereby improve the work environment for the operating personnel involved, a dust extractor (25″) having an internal space (39″) and a web stabilizing, imperforate plane (37″) is mounted immediately adjacent to an intended path of travel for the creped web (1) so that the web during its transportation will place itself in a fixed position close to the imperforate plane (37″), and, at least an essential part of an entrained boundary layer of dust containing air is eliminated through suction only, to the internal space (39″). The suction is carried out at the rear and/or front edge of the extractor (25), and suitably both on the overside and underside of the web (1). Dust that does not become entrained in the boundary layers will be sucked away by at least one dust suction box (55) having a sloping suction box cover (57), and mounted under the web (1) and spaced therefrom at doctor beam (11). Preferably, an air stream, which is of sufficient force to carry the dust and caused by the suction, is made rise towards the web (1) between the dust suction box (55) and a dust extractor (27) mounted downstream of the latter.

25 Claims, 1 Drawing Sheet

METHOD AND APPARATUS FOR EXTRACTING DUST THAT IS RELEASED WHEN CREPING OFF A PAPER WEB

BACKGROUND AND SUMMARY OF THE INVENTION

The present invention relates to a method of extracting dust that is separated on creping a soft crepe paper web off a Yankee dryer by means of a creping doctor, where part of the dust is carried along the web in a boundary layer of air which, because of the movement of the web from the Yankee dryer towards a reel, becomes entrained and follows the web. The invention also relates to an apparatus for carrying out the method.

When creping a soft crepe paper web, for example a tissue web, off a Yankee dryer, dust in the form of fibres and other particles is separated from the web. In order to lead that dust away, it has been proposed in U.S. Pat. No. 4,019,953 to Nystrom that a collecting receptacle should be mounted under the dust generating zone. To this receptacle, a compressed-air line and a suction line are connected for carrying away dust laden air entrained by compressed-air jets across the path of movement of the web. However, a flow of compressed-air is necessarily directed against the web, since to just suck away the dust through the ventilation has a negligible effect at this distance.

Also, such an apparatus is unwieldy, requires a lot of space, is relatively inefficient, and it only takes care of that part of the dust that falls down under the dust generating zone. The high velocities of modern tissue machines contribute to the poor result, i.e. in the range of 25 m/s, which means that dust laden air is entrained on both sides of the travelling tissue web, which is very fragile because of its low grammage. The apparatus proposed in U.S. Pat. No. 4,019,953 is not used in actual operation.

The separation of dust from the surface of a paper web is a problem also at slitting, slitting-winding and rewinding of the paper web. U.S. Pat. No. 3,775,806 to Olbrant, et al. proposes an arrangement for vacuum-cleaning the surface of a paper web. In order to avoid that the paper web during the vacuum-cleaning is sucked against the suction device and thereby damaged, a flow of air is directed towards the web simultaneously with the vacuum suction. The proposed vacuum-cleaning device thus has an upward open, horizontal sheet steel channel surrounding a square blowing-air pipe and extending across the web. The side of the blowing-air pipe facing the web has eyelid type openings turned from each other, to direct compressed-air jets principally parallel to the web both against and along the path of transportation of the web and thereby attaining a fixed distance of the web from the vacuum-cleaning device. Intermediate openings of the same type can be provided for directing compressed-air jets towards the surface of the web, to improve the effect of the vacuum cleaning by blowing dust off the surface. The blown air and released dust are sucked away in a direction perpendicular to the web through the two gaps that are formed upstream and downstream of the blowing-air pipe between the same and the surrounding sheet steel channel, to which an air sucking means is connected. The wall parts of the sheet steel channel, which are situated nearest the web, may be vertically adjustable in such a way that the blown-in, dust conveying air does not flow past the suction gaps and that the paper web does not scrape against the wall parts and become damaged.

The vacuum cleaning effect that is achieved by the arrangement according to U.S. Pat. No. 3,775,806 does not, though, meet today's demands when it comes to also taking care of the dust that follows in the air around a travelling paper web. Furthermore, this arrangement becomes both space demanding and expensive to buy and operate because of the compressed-air flow needed by the blowing-in technology.

The object of the present invention is to achieve an improved catching and extraction of the dust that results from the creping of a tissue web or any other soft crepe paper web and to thereby achieve an improved work environment for the operating personnel involved.

According to the invention, this object is achieved in the above stated method by mounting a dust extractor having an internal space and a web stabilizing imperforate plate in the immediate vicinity of an intended path of travel of the creped web so that the web during the travelling will take a fixed position, close to the imperforate plate, and eliminating at least an essential part of the dust-containing boundary layer of air by mere vacuum suction of the internal space.

In an apparatus for carrying out the method, the aforementioned object is achieved in a corresponding way, according to the invention, in that the apparatus comprises a hood of paper web width, having a front side edge and a rear side edge in relation to the advancing direction of the web, an imperforate plane cover sheet located to substantially close the hood while defining an internal space and forming a gap between at least one of said side edges and the cover plate, means for producing a subatmospheric pressure in the internal space, so that air is sucked through the gap, said apparatus being adapted to be mounted with its cover plate in the immediate vicinity of an intended path of transportation of the creped web, whereby the plane imperforate cover plate has a web stabilizing effect, so that the web at transport will take a fixed position close to the cover plate and the gap will be situated in the dust-containing boundary layer.

The invention is based on the realization that in order to solve the dust problems in tissue machines and the like it is necessary to suck away the dust laden boundary layers of air, which on creping, build up around the fast advancing web and to manage to suck sufficiently close to the creped web, the web must be stabilized and prevented from fluttering and the position of the web must be fixed. By the use of an imperforate plane, the web will be stabilized and fixed at a comparatively very short distance from the plane, without simultaneously getting a detrimental slowing down of the web against the plane, and hereby it is possible to work with vacuum suction only, instead of combined blowing and sucking to eliminate the dust. Advantageously, the distance is so short that the web very lightly touches the plane.

When vacuum sucking at a front or upstream edge of the apparatus in relation to the direction of web travel, it is suitable that the air flow just before and in the suction gap is mainly parallel to the web plane, so as to minimize such detrimental whirling that could convey part of the dust laden boundary layer away from the dust extracting apparatus. At the rear or downstream edge, it is, however, suitable that the air just before getting sucked into the suction gap also has a component of movement directed towards the web, so as to entrain dust that is very close to or on the web surface. Preferably, the suction velocity is of the same order of magnitude as the travelling velocity of the web. Thereby, at said rear edge, the relative velocity between the air stream at the suction gap and the web will be in the range twice the web velocity, which will give a really good dust extraction effect.

At creping, most of the dust arises on the side of the web that comes into contact with the creping doctor, but since the boundary layers on both sides of the web will contain dust, it is of course suitable to extract by sucking only an essential portion of each of the two boundary layers.

Part of the dust that is separated from the web at the doctor blade, which usually is located under the web and under the point where the web is doctored off the Yankee dryer, is not caught and conveyed off by the boundary layer on the underside of the web but falls downwards. To catch and extract even that falling dust, it is advisable to provide a dust suction box adjacent to the doctor beam. The suction box has a cover, which is sloping downwards and outwards from the Yankee dryer to prevent the web from getting stuck to the cover in the event of a possible web break.

At a certain distance downstream of the dust suction box, there suitably is a dust extractor working on suction basis only, to suck off the boundary layer of the web underside. Preferably, the distance will be such that under normal operating conditions, i.e. at normal web velocity and with normal suction forces in the dust suction box and in the dust extractor, between these two suction devices, an upwards directed air stream is created, which essentially extends over the whole mentioned distance and is strong enough to carry substantially all of the dust particles separated from the web.

Since the creping doctor blade is not in close contact with the Yankee dryer, part of the dust particles will pass inbetween the blade and the roll. To take care of them, it is suitable to provide a second dust suction box on the opposite side of the doctor beam in relation to the first dust suction box. The second dust suction box can be designed as the first one but reversed.

Preferably, the dust extractor is mounted in the immediate vicinity of the intended path of travel of the creped web in a position such that the web will touch the imperforate plane. On a macroscopic scale, this touch is defined as at least a line of contact extending across substantially the whole width of the web. Such a line of contact is suitably located at least at a downstream end of the imperforate plane but can, in addition, be located also at an upstream end of the plane. The touch of the web against the plane gives a certain working of the creped paper web, which effectively contributes to the extraction of web carried dust by the suction at the downstream end of the extractor. There, the web will be subjected to a pulse of air that passes through the creped porous web from its underside to its upperside when the extractor is placed on the upperside of the web. On passing through the web, the air pulse will dislodge dust particles, so that they may be carried away by the air flow sucked into the downstream end of the extractor. A certain dust particle dislodging effect may also result from microturbulence caused by shear in the thin boundary layer of air between the web and the dust extractor.

The invention gives a very efficient catching and extraction of the dust that is separated from the web at creping and it, thus, brings about a decided and very marked improvement of the work environment for the operating personnel concerned.

Further features of the invention and what is achieved thereby will be apparent from the following description. The invention will hereafter be described more in detail with reference to the enclosed drawings.

DESCRIPTION OF PREFERRED EMBODIMENT

Figure 1:
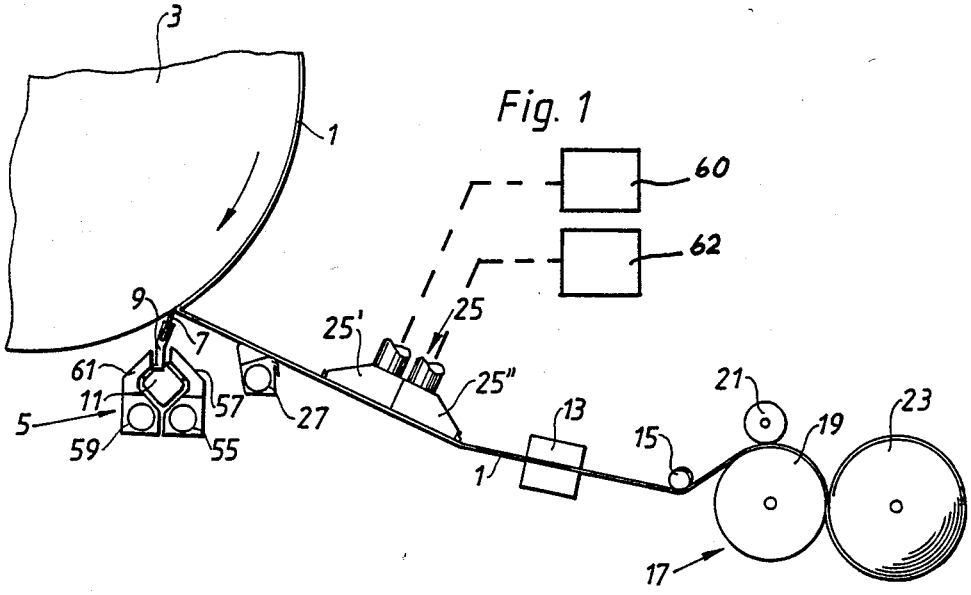
FIG. 1 is a schematic side elevational view of a section situated between a Yankee dryer and a reel in a soft crepe paper machine, said section being provided with a plurality of preferred, varying embodiments of a dust extractor according to the invention.

In the soft crepe paper machine section shown schematically in FIG. 1, a paper web adhering to the envelope surface of a clockwise rotating Yankee dryer 3 is lead downwards to a creping doctor 5. There, the web 1 is creped off the Yankee dryer 3 by a creping blade 7, which is mounted on a holder 9 extending mainly vertically upwards from a doctor beam 11. From the doctor blade 7, the creped paper web 1 runs obliquely downwards and through a grammage scanner 13 and a spreader formed as a curved bar 15 before it reaches reel 17. In the arrangement shown, the latter consists of a drum winder with a drive cylinder 19. An empty reel spool 21 has just been lowered down to contact with drive cylinder 19, next to which a readymade reel 23 of soft crepe paper is shown.

At creping, dust separates from web 1, and part of this dust will be entrained in a boundary layer on each side of the creped web, that can run forward at a velocity of close to 25 m/s. Most of the remaining dust on both sides of the doctor blade 7 and the holder 9 is bound to fall down towards the doctor beam 11. To catch and extract at least an essential part of the dust contents in the boundary layers, a plurality of dust extractors are provided between the creping doctor 5 and the grammage scanner 13. In the embodiment shown in FIG. 1, a first and a second such extractor 25' and 25'', respectively, have been fitted together to form an assembly 25, which is mounted above the web 1 to catch and extract the dust contents in the boundary layer on the upper side of the web 1. A third dust extractor 27 is mounted under the web 1 upstream of the unit 25 to catch and extract the dust contents in the boundary layer on the underside of the web 1.

Figure 2:
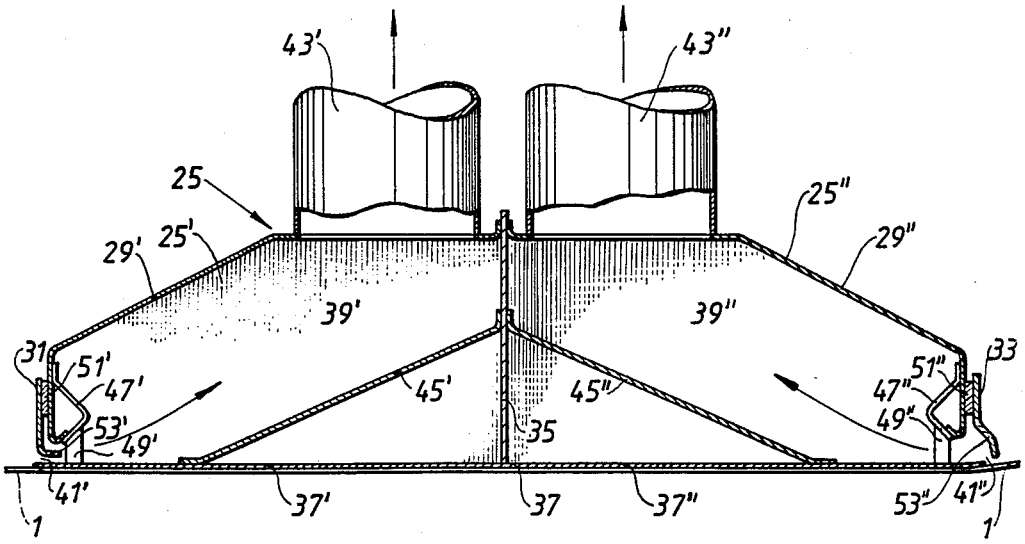
FIG. 2 is a schematic side elevational view, which on a larger scale shows an assembly included in FIG. 1 and comprising two dust extractors assembled together.

According to the invention, each of the dust extractors 25' and 25'', as is best shown in FIG. 2, comprises a web-wide hood 29' and 29'', respectively, with a front side edge and a rear side edge compared to the advancing direction of the web 1. The front edge of hood 29' is denoted by 31 and the rear edge of hood 29'' is denoted by 33. The hoods 29' and 29'' are built together tandemwise to form a unit and are separated by a common partition wall 35. An imperforate flat cover plate 37 has a front half 37' and a rear half 37'', located to substantially close the corresponding hood 29' and 29'', respectively, as to define an internal space 39' and 39'', respectively, and form a gap 41' between hood 29' and the front cover plate half 37'', and a gap 41'' between hood 29'' and the rear cover plate half 37''. The both internal spaces 39' and 39'' are not interconnected. Instead, there are separate means for the two spaces 39' and 39'', shown as suction pipe stubs 43' and 43", which are connected to air exhausters 60 and 62, respectively, for separately regulating the subatmospheric pressure in the spaces 39' and 39" and thereby the suction of air through the gaps 41' and 41".

Preferably, the plane cover plate 37 shows a relatively high degree of flatness accuracy. A tolerance range in the order of 1.5 mm is recommended. To avoid that the dust extractors 25' and 25" become deformed under operation to an extent that would be detrimental to their function, it is advisable that they are provided with stiffeners in a manner conventional for sheet-metal designs. In the embodiment shown in FIG. 2, a stiffening, inclined sheet-metal member 45' and 45", respectively, extends in each of the spaces 39' and 39" from a line somewhat inside each of the gaps 41' and 41" to a horizontal line about half-way up the common partition wall 35. These inclined sheet-metal members also contribute to deflect the air stream from the gaps towards the suction pipes. Furthermore, at the gaps 41' and 41", the hoods 29' and 29" are internally stiffened with each a sheet-metal angle strip 47' and 47", respectively, extending along the gap, and from each of these angle strips, a plurality of legs 49' and 49" protrude down to the top surface of the plane cover plate 37. On the external side of the part of the hood 29' and 29" that is stiffened with the angle strips 47' and 47", a flat bar 51' and 51", respectively, is extending along the gap 41' and 41". In each one of these flat bars, there is a row of screws screwed-in, not shown, which extend through slots, not shown, running perpendicularly to the plane of the cover plate 37 and arranged on a sheet-metal strip 53' and 53", respectively, that can slide to and from the plane of the cover plate 37 to adjust the widths of the associated gaps 41' and 41", respectively. As can be seen from FIG. 2, the gap delimiting edge of the sheet-metal strip 53" is situated downstream of the downstream edge of the cover plate 37, whereby the real suction gap at operational conditions will be formed between the sheet-metal strip 53" and the web 1.

The assembly 25 that consists of the two extractors 25' and 25" is, in the soft crepe paper machine, mounted with its cover plate 37 located immediately beside an intended travelling path for the creped web 1. Thereby, the plane imperforated cover plate 37 will have a web stabilizing effect, so that the web 1 when travelling will have its position fixed close to and very lightly touch the cover plate 37, and the gaps 41' and 41" will be situated in the dust-containing boundary layer. In the embodiment shown in FIG. 2, the paper web is deflected a few degrees in counter clockwise direction when passing the upstream edge of the cover plate 37. At the downstream end of the cover plate 37, about 1.5 cm of the plate 37 is somewhat tilted upward, so that the paper web 1 is deflected some more than 10 degrees in counter clockwise direction, before the web 1 runs further in straight direction to the grammage scanner 13. The very light touch is obtained both at the upstream and the downstream edges of cover plate 37. The touch gives a certain working of paper web 1, which at the downstream edge of cover plate 37 effectively contributes to the extraction of dust carried by web 1. As described above, at the downstream edge of cover plate 37 web 1 will be subjected to a pulse of air that passes through the creped porous web 1 from its underside to its upperside, when dust extractor 25 is located on the upperside of web 1. On passing through web 1, the air pulse will dislodge dust particles so that they may be carried away by the air flow sucked into the downstream end of dust extractor 25. A certain dust particle dislodging effect may also result from microturbulence caused by shear in the thin boundary layer of air between web 1 and dust extractor 25.

Since not all dust that is separated from the web 1 at the creping-off of the Yankee dryer 3 will be entrained by the boundary layers on both sides of the web 1, part of the separated dust will fall down from the area adjacent the doctor blade 7. To catch a major portion of this dust, a dust suction box 55 is provided, as shown in FIG. 1, immediately adjacent the doctor beam 11 on the side facing the creped web 1. The dust suction box 55, which for example can be screwed on the beam 11 by means of screws, not shown, has a suction box cover 57. This is sloping downwards and outwards from the Yankee dryer 3, and the lower longside edge of the suction box cover 57 is situated at a considerable distance from the boundary layer on the underside of the creped web 1. The suction box cover 57 is suitably made of perforated sheet-metal and is sloping in such a manner that the web 1, when possibly breaking, will not fall down and remain on the suction box cover 57 but will instead slide further downwards to a collecting place. Preferably, a second dust suction box 59, which comprises a suction box cover 61 and is of a design that in all essentials is reversed in comparison to dust suction box 55, is provided immediately adjacent the opposite side of the doctor beam 11, onto which it may be screwed.

The third dust extractor 27 is, as mentioned above, mounted under the creped web 1 upstream of the assembly 25 in order to eliminate at least an essential portion of the dust-containing boundary layer on the under side of the web 1. The extractor 27 is of the same principle construction as the second, rearmost dust extractor means 25" and, consequently, is working by suction only, at the rear edge of an imperforate plane, web-stabilizing cover plate.

The distance between the third dust extractor 27 and the dust suction box 55, which is located on the side of the creping doctor 5 facing the creped web, and the suction in these dust removing devices are so balanced in relation to each other that the space between these devices is in all essentials completely occupied by a rising air stream, strong enough to carry substantially all of the dust particles that are separated from the web 1. Such an air stream in the space where the dust is the densest contributes strongly to the control of the problem of dust removal and results in an important improvement of the work environment for the personnel involved. In order to facilitate the desired flow of air, the wall members, between which the distance in question is defined, can be designed as illustrated in FIG. 1 so as not to unnecessarily prevent the flow.

The invention is not restricted to what is shown on the drawings, but a plurality of modifications, not shown and not described, are possible within the scope of the appended claims. For example, the dust extractor 27 under the web 1 can be exchanged against an assembly like assembly 25 on the upper side of the web and provided with a suction gap also at the front edge, provided that there is space enough for such an assembly. Furthermore, a sheet-metal strip of same design as sheet-metal strip 53", which at the rear edge of the assembly 25 defines the suction gap against the web, replaces the sheet strip 53', which, at the front edge of the assembly 25, defines the suction gap against the plane, imperforate cover plate 37.

That which is claimed is:

1. A method of extracting dust entrained in a boundary layer of air running with an advancing paper web, wherein the dust is separated from the paper web as the paper web is creped off a Yankee dryer by a creping doctor, the method comprises the steps of directing the advancing web along a predetermined path of travel past a dust extractor having an internal space and an imperforate plane cover plate such that one side of the web runs adjacent the imperforate plate and adjacent a gap along at least one of a front or rear edge, in relation to the direction of travel of the web, of said dust extractor, and extracting from the advancing paper web exclusively by suction into the internal space of the dust extractor at least a portion of the dust containing boundary layer.

2. The method according to claim 1, wherein the step of extracting a dust containing boundary layer comprises extracting said dust containing boundary layer at the rear edge of the dust extractor.

3. The method according to claim 2, wherein the rear edge of said dust extractor has an adjustable transverse gap, and the step of extracting dust includes adjusting the gap at said rear edge.

4. The method according to claim 3, wherein the step of extracting the dust containing boundary layer further comprises providing suction at such a volumetric flow rate that the air velocity in the gap is of the same order of magnitude as the velocity of the moving web and the air direction is opposed to the direction movement of the web.

5. The method according to claim 2, wherein the step of extracting the boundary layer of air further comprises also extracting by suction the dust containing boundary layer at the front edge of the dust extractor.

6. The method according to claim 1, comprising the additional step of extracting a boundary layer of air from the opposite side of the advancing web exclusively by suction.

7. The method according to claim 6, wherein the creping doctor includes a doctor beam located beneath the web as the web is led away from the Yankee dryer, and wherein the step of extracting a boundary layer of air from the opposite side of the advancing web comprises the steps of directing the advancing web over a dust suction box located immediately adjacent to the doctor beam on the side facing the web, the suction box having a suction box cover which slopes downwardly and outwardly from the Yankee dryer with a lower long side edge situated at a distance from the boundary layer on the underside of the web, providing at a distance from the creping doctor, a web stabilizing, suction acting second dust extractor and extracting a boundary layer of air from the underside of the web thereby, and the method further comprises balancing said distance and the suction in the dust suction box and in the suction acting second dust extractor in relation to one another so as to provide a rising air stream between the said dust suction box and said second dust extractor strong enough to carry substantially all the dust particles separated from the web.

8. The method according to claim 7, further comprising providing immediately adjacent the doctor beam on the side opposite said dust suction box a second dust suction box and suctioning off dust from the creping doctor and the Yankee dryer with the second suction dust box.

9. The method according to claim 7, wherein said step of directing the advancing web past said second dust extractor further comprises directing the web past the second dust extractor downstream of said suction box.

10. The method according to claim 1, wherein the step of directing the web past the dust extractor further comprises directing the web so that the imperforate plate contacts the advancing paper web at least along a line of contact extending substantially across the entire width of the web.

11. The method according to claim 10, wherein the line of contact is at the downstream end of the plate.

12. An apparatus for extracting dust entrained in a boundary layer of air adjacent an advancing paper web that is advanced along a predetermined path of travel comprising:

a hood located adjacent one side of the predetermined path of travel of the web and having a width corresponding to that of the paper web and having a front side edge and a rear side edge with respect to the path of travel, an imperforate plane cover plate located adjacent the hood and defining an internal space between the cover plate and the hood, said cover plate being so positioned relative to said front side edge and said rear side edge of said hood as to form a gap along at least one of the front and rear side edges, and said cover plate being positioned in the predetermined path of travel of the web such that the web passes thereacross and the gap is situated in the dust containing boundary layer of air adjacent the advancing web, and means for producing a subatmospheric pressure in said internal space to draw air through said gap so as to effectively extract the boundary layer of air from the traveling web exclusively by suction while stabilizing the web as it travels along the path adjacent the imperforate plane cover plate.

13. The apparatus according to claim 12, wherein said gap is formed at said rear side edge of the apparatus.

14. The apparatus according to claim 12, further comprising an adjustably mounted strip along the gap to adjust the width of the gap.

15. The apparatus according to claim 12, wherein a gap is provided at each of said front and rear side edges.

16. The apparatus according to claim 15, wherein means are provided for dividing the internal space into two separate internal spaces respectively connected to separate means for producing a subatmospheric pressure.

17. The apparatus according to claim 16, wherein the separate means for producing a subatmospheric pressure are separately controlled to provide different air velocities at each of the gaps at the front and rear side edges.

18. The apparatus according to claim 12, further comprising a suction box at the other side of the predetermined path of travel from the imperforate plane cover plate for extracting dust entrained in a boundary layer of air on the other side of the advancing web.

19. The apparatus according to claim 18, wherein the suction box is upstream of the imperforate plane cover plate.

20. The apparatus according to claim 12, wherein the imperforate plane cover plate contacts the advancing web along a line of contact.

21. A method of extracting dust entrained in a boundary layer of air running with an advancing paper web, wherein the dust is separated from the paper web as the paper web is creped off a Yankee dryer by a creping doctor, the method comprising the steps of directing the advancing web along a predetermined path of travel past a dust extractor having an internal space and an imperforate plate such that the predetermined path of travel of the web runs adjacent the imperforate plate, and wherein a rear edge, in relation to the direction of travel of the web, of said dust extractor has an adjustable transverse gap, extracting from the advancing paper web by suction into the internal space of the dust extractor at least a portion of the dust containing boundary layer by providing suction at such a volumetric flow rate that the air velocity in the gap is of the same order of magnitude as the velocity of the moving web and the air direction is opposed to the direction movement of the web and wherein the step of extracting dust includes adjusting the gap at said rear edge.

22. A method of extracting dust entrained in a boundary layer of air running with an advancing paper web, wherein the dust is separated from the paper web as the paper web is creped off a Yankee dryer by a creping doctor, the method comprising the steps of directing the advancing web along a predetermined path of travel past a dust extractor having an internal space and an imperforate plate such that the predetermined path of travel of the web runs adjacent the imperforate plate, and wherein the dust extractor has a front edge and a rear edge in relation to the direction of travel of the web, and extracting from the advancing paper web into the internal space of the dust extractor by suction at the front edge and at the rear edge of the dust extractor at least a portion of the dust containing boundary layer.

23. An apparatus for extracting dust entrained in a boundary layer of air adjacent an advancing paper web that is creped off a Yankee dryer by a creping doctor and advanced along a predetermined path of travel comprising:

a hood located adjacent one side of the predetermined path of travel of the web and having a width corresponding to that of the paper web and having a front side edge and a rear side edge with respect to the path of travel, an imperforate plane cover plate located adjacent the hood and defining an internal space between the cover plate and the hood, and a gap along the front and rear side edges, means cooperating with said hood and said cover plate for dividing the internal space into two separate internal spaces, and means respectively connected to each of said two separate internal spaces for producing a subatmospheric pressure in said internal spaces to draw air through each gap so as to effectively extract the boundary layer of air from the traveling web and whereby the web is stabilized as it travels along the path adjacent the imperforate plane cover plate.

24. The apparatus according to claim 23, including separate control means cooperating with each of said separate means for producing a subatmospheric pressure for providing different air velocities at each of the gaps at the front and rear side edges.

25. A method of extracting dust entrained in a boundary layer of air running with an advancing paper web, the method comprising the steps of directing the advancing web along a predetermined path of travel past a dust extractor having an internal space and an imperforate plane cover plate such that one side of the web runs adjacent the imperforate plate, and adjacent a gap along at least one of a front or rear edge, in relation to the direction of travel of the web, of said dust extractor, and extracting from the advancing paper web exclusively by suction into the internal space of the dust extractor at least a portion of the dust containing boundary layer.

* * * * *